US005655676A

United States Patent [19]

Kairis

[11] Patent Number: 5,655,676

[45] Date of Patent: Aug. 12, 1997

[54] CHORD PROTECTOR

[76] Inventor: Richard J. Kairis, 5711 Wanda Pl., Downers Grove, Ill. 60516

[21] Appl. No.: 387,032

[22] Filed: Feb. 10, 1995

Related U.S. Application Data

[63] Continuation of Ser. No. 974,953, Nov. 12, 1992, abandoned.

[51] Int. Cl.[6] ..... B66C 23/62

[52] U.S. Cl. ..... 212/347; 212/177; 52/717.04; 52/717.01; 52/DIG. 13

[58] Field of Search ..... 37/115, 116; 52/736.3, 52/736.4, 737.4, 737.5, 116–119, DIG. 12, DIG. 13, 287.1, 288.1, 716.5, 716.6, 716.7, 717.01, 717.04, 717.05; 212/293, 177, 309, 317, 223, 227, 231, 255, 347, 167

[56] References Cited

U.S. PATENT DOCUMENTS

| | | | |
|---|---|---|---|
| 817,862 | 4/1906 | Mitchell | 212/177 |
| 3,092,259 | 6/1963 | Swanson | 212/177 |
| 3,392,498 | 7/1968 | Rogers | 52/717.04 |
| 3,934,385 | 1/1976 | Paulus et al. | 52/716.5 |
| 4,003,475 | 1/1977 | Brolin | 212/347 |
| 4,259,812 | 4/1981 | Adell | 52/716.5 |
| 4,280,628 | 7/1981 | Goss et al. | 212/347 |
| 4,646,907 | 3/1987 | Strebig et al. | 52/DIG. 13 |

FOREIGN PATENT DOCUMENTS

| | | | |
|---|---|---|---|
| 211137 | 7/1984 | Germany | 212/300 |

*Primary Examiner*—Karen B. Merritt
*Assistant Examiner*—R. B. Johnson
*Attorney, Agent, or Firm*—McAndrews, Held & Malloy, Ltd.

[57] ABSTRACT

A chord protector employs a resilient covering affixed to an appropriate crane element, extension, lattice structure or headache ball, to protect a chord from damage during a collision with a headache ball or other weighty object. The chord protector can be constructed of a variety of materials. In one embodiment, the chord protector is constructed of high-impact plastic, and lined with an elastomeric or rubber material which in turn is fastened to a chord of the lattice section using a disengagable hook and loop fastener. Another embodiment includes an elastomeric covering on the headache ball.

7 Claims, 2 Drawing Sheets

FIG. 1
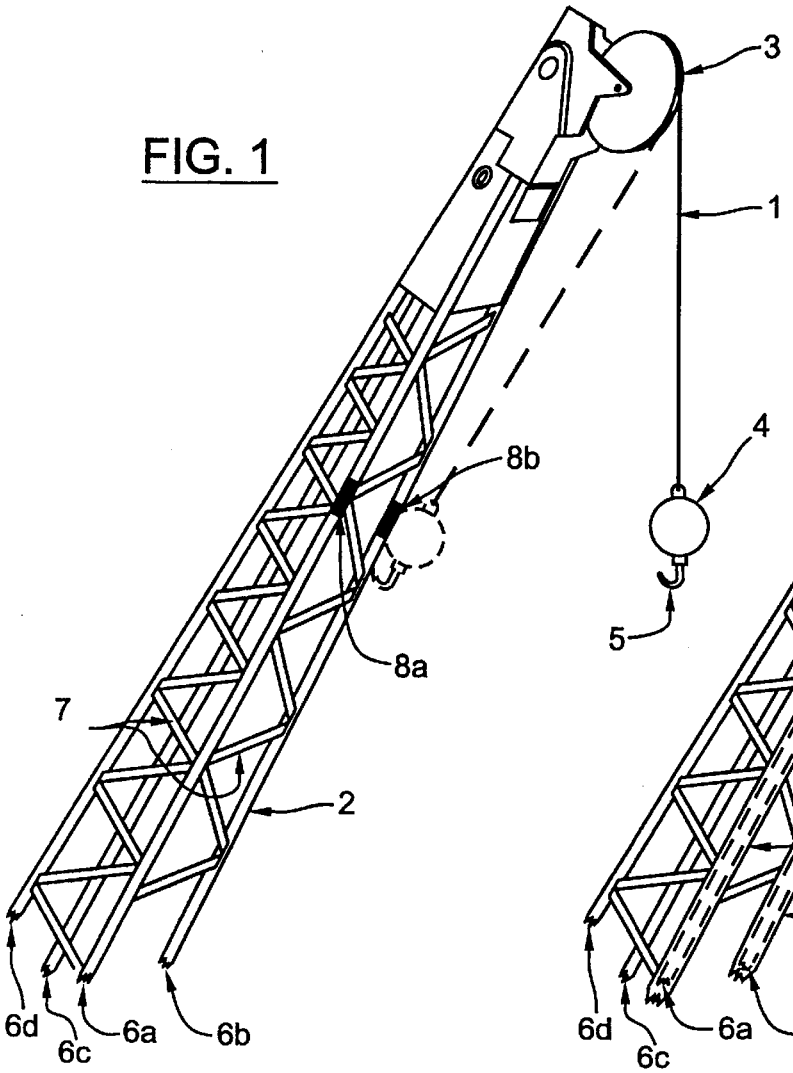
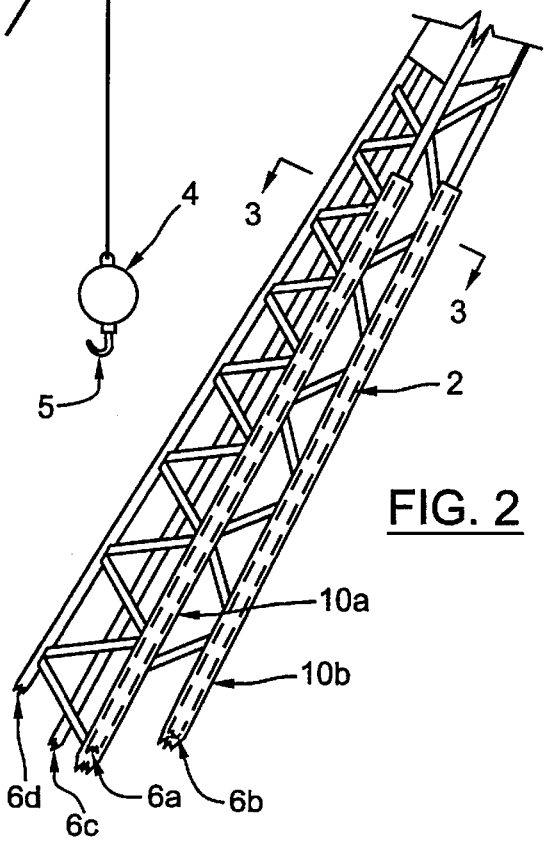
FIG. 2
FIG. 3
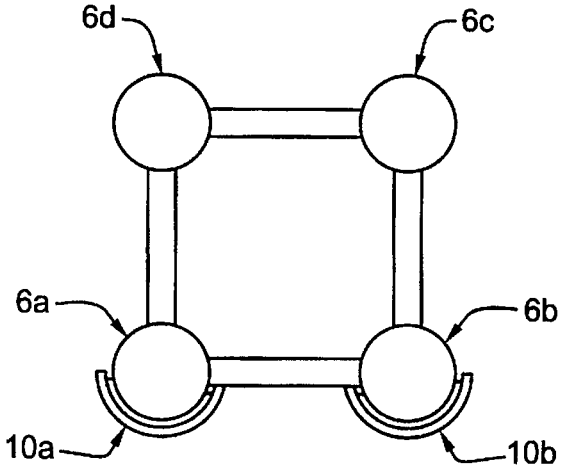
FIG. 4
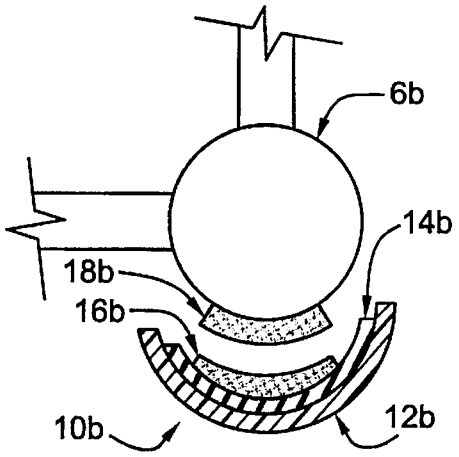

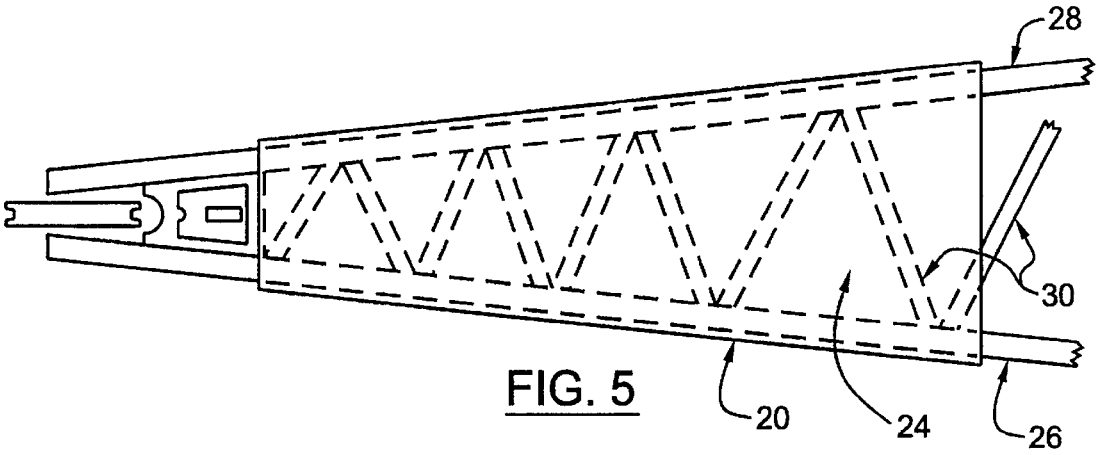
FIG. 5
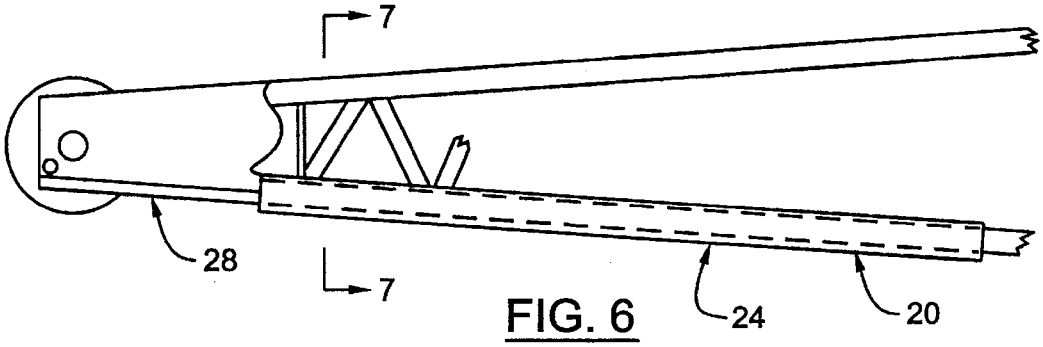
FIG. 6
FIG. 7
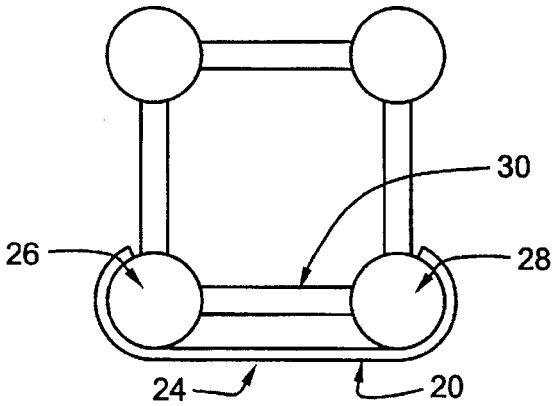
FIG. 8
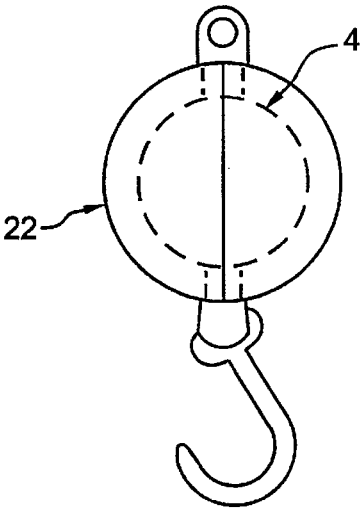

CHORD PROTECTOR

CROSS-REFERENCE TO RELATED APPLICATION

The present application represents a continuation application of Ser. No. 07/974,953, filed Nov. 12, 1992, abandoned.

FIELD OF INVENTION

This invention relates to field of structural lattices, including those used in the lattice sections of cranes, and to the means used to protect such lattices from damage due to an impact with a heavy object such as a headache ball.

BACKGROUND OF THE INVENTION

Mobile cranes have been designed with telescopic booms, and boom extensions, to handle heavier loads and raise those loads to greater heights. The load handling capacities of booms and boom extensions are increased to accommodate loads and longer extensions for reach. One of the ways to increase the load-handling capacity of a boom is to increase its cross sectional dimensions, and the thickness Of the materials from which it is made. As boom sections increase in size and material thicknesses increase, the booms can become heavier which may decrease lifting capacity. Various approaches in boom design and construction have been employed to achieve greater size and strength without adding undue weight. It is now common practice, for example, for lattice extensions to be attached to the tips of booms, to extend the effective reach of the boom without adding undue weight. In certain stationary and crawler type cranes, the support for the boom is also of lattice construction.

The principle elements of the lattice section of a crane are its chords, which run the length of the lattice section, and struts which tie the chords together. Typically, a lattice section will have three or four chords, and numerous struts.

In typical crane lifting operations, involving a crane having a lattice section or extension, a wire rope passes over a sheave at the end of the lattice section. The sheave supports the wire rope, which, in turn, supports a headache ball and load hook, from which a load may be suspended.

When a lattice section of a crane is dismantled from the lower boom section, then transported, sleeves are often used to protect the chords of the lattice section against abrasion. When a crane having a lattice section is in operation, however, a kind of damage significantly more severe than mere abrasion may happen to lattice section extension—e.g., a strut or chord may be impacted by a headache ball swinging from the end of its wire rope. Typically, sleeves Which are used to protect transported equipment are not designed to protect a lattice section from the severe damage that may be caused by the impact of a headache ball.

Although a damaged strut can often be repaired or replaced, the repair or replacement of a chord is often infeasible due to the chord's large size and many connections. If a crane operator uses a lattice. extension containing a damaged chord, the operator may risk both personal injury and property damage.

For the safety of the operator and others, and because of practical difficulties involved in the repair of a damaged chord, it is not uncommon for a manufacturer to recommend the abandonment of an entire damaged lattice section. When a lattice section has to be abandoned, it is generally costly in terms of lost time and money, and construction delays.

OBJECTS OF THE INVENTION

An object of the present invention is to minimize the structural damage which could otherwise occur to a chord of a crane lattice section or extension if it were to be hit by a swinging headache ball or other significant impact. Additional related objects of the invention are to minimize the frequency with which the lattice sections or extensions of cranes need to be replaced, to protect the lattice from damage during transportation to and from construction sites, and to maximize crane operator safety without adding unduly to the tare weight of the crane.

SUMMARY OF THE INVENTION

The above and other objects are accomplished by providing a chord protector detachably affixed to an appropriate chord, headache ball, or other appropriate structural element of a carrier or fixed-mounted crane, A-frame jib, telescoping jib, or similar boom. The chord protector can be constructed of a variety of materials. In one embodiment, the chord protector is constructed of high-impact plastic, and lined with an elastomeric or rubber material, which in turn is fastened to a chord of the lattice section or extension using a disengagable hook and loop fastener. Another embodiment includes an elastomeric covering on the headache ball.

BRIEF DESCRIPTION OF THE DRAWINGS

FIG. 1 is a perspective view of a crane lattice section and headache ball, wherein is shown dented chords and an indication of how a headache ball could cause such damage.

FIG. 2 is a perspective view of the lattice section of a crane, wherein two lower chords are faced with chord protectors.

FIG. 3 is a sectional view taken in the direction of line 3—3 in FIG. 2 showing the preferred embodiment of the chord protector in a crane lattice section or extension.

FIG. 4 is an enlarged sectional view of one of the cord protectors illustrated in FIG. 3.

FIG. 5 is a bottom plan view of an alternative embodiment of the cord protector of the present invention.

FIG. 6 is a side view of the alternative embodiment of the cord protector of FIG. 5.

FIG. 7 is a sectional view taken in the direction of line 7—7 in FIG. 6 of the cord protector of the alternative embodiment.

FIG. 8 is an exploded perspective view of a headache ball, showing the chord protector in a headache-ball embodiment.

DETAILED DESCRIPTION OF THE PREFERRED EMBODIMENT

Referring to FIG. 1 of the drawings, there is shown a perspective view of a crane lattice section 2, comprised of four chords 6*a*, 6*b*, 6*c*, and 6*d*, and numerous struts 7. Also shown in FIG. 1 is an indication of how a headache ball 4 and hook 5, suspended by a wire rope 1 from a sheave 3, could swing into and damage chords 6*a* and 6*b*, causing indentations 8*a* and 8*b*.

Turning to FIG. 2, there is shown a perspective similar to that shown in FIG. 1, except that the two lower chords 6*a* and 6*b* of the crane lattice section 2 are shown covered with chord protectors 10*a* and 10*b*. Turning next to FIG. 3, there is shown a sectional view taken in the direction of line 3—3 in FIG. 2, showing the chord protectors 10*a* and 10*b* relative to the chords 6*a*, 6*b*, 6*c* and 6*d* in a crane lattice section. Although a lattice section having four chords is shown, this embodiment would work equally well with a lattice section having only three chords. Although chords are shown in a rectangular arrangement, the embodiment would work equally well with a trapezoidal chord arrangement. It should also be noted that, although the embodiment shown has only 2 chord protectors, additional protection may be afforded by the use of additional chord protectors on chords 6*a*, 6*b*, 6*c* and 6*d*.

FIG. 4 is an enlarged sectional view of chord protector 10*b* taken in the direction of line 1—1. In the embodiment shown, chord protector 10*b* comprises an elastic casing 12*b*, made out of high-impact plastic; and a resilient layer 14*b*, made out of a resilient elastomeric or rubber material, bonded to the casing 12*b*. As an alternate embodiment, chord protector 10*b* may be comprised of a uniform elastic material, such as the resilient elastomeric material 14*b*, without casing 12*b*. The high-impact plastic or resilient layer may be wrapped partially or completely around the chords.

A fastening strip 16*b*, preferably formed of disengagable loop material, such a VELCRO, is bonded to the resilient elastomeric material 14*b*. A corresponding fastening strip 18*b*, preferably formed of disengagable hook material, is bonded to lower chord 6*b* along a line nearest the headache ball in resting suspension. Fastening strip 18*b* is capable of engaging corresponding fastening strip 16*b* such that chord protector 10*b* is retained on lower chord 6*b* during operation of the crane. Clamps and other well-known fasteners may also be used.

In FIGS. 5, 6 and 7 is shown an alternate embodiment of the chord protector 20, which provides for a continuous chord protector 24. The continuous chord protector 24 further provides impact protection for the chords 26 and 28 and struts 30. The continuous chord protector 24 would be constructed and attached to the chords in a fashion similar to that described for the multiple chord protectors 10*a* and 10*b* above. Although not shown, the chord protector may wrap substantially around the chords. In addition, the continuous chord protector 24 may be an open-frame design having a protective covering for the chords with slots or openings intermediate the chords.

In FIG. 8 is shown still another embodiment of the chord protector 22 which, while analogous to the chord protectors 10*a* and 10*b* shown in FIGS. 2 and 3, is placed over the headache ball 4, which also is useful in preventing possible damage to whatever the headache ball may come into contact with on a typical construction site.

Having fully described my invention, it is to be understood that I do not wish to be limited to the details herein set forth, but my invention is the full scope of the appended claims.

I claim:

1. In a crane lattice section including a plurality of spaced longitudinally elongated cord members of a predetermined shape and fixed in a predetermined arrangement, a plurality of diagonal struts interconnecting said spaced cord members, wire rope sheave means mounted at one end of said cord members, a wire rope suspended from said sheave means, a suspended article attached to and supported by said wire rope, wherein the improvement comprises:

a cord protector including a first hook and fastening means attached to at least a selected two of said plurality of cord members, a casing extending along a portion of the longitudinal length and wrapped at least partially around the selected cord members, said casing being configured to correspond to the predetermined shape of the respective cord members of the respective cord members, a second hook and fastening means mounted on said casing and detachably engaged with said first hook and fastening means to attach said casing to said selected cord members, whereby said casing is operative to protect said selected cord members from damage that may be caused by collisions with said suspended article.

2. In a crane lattice section according to claim 1, wherein said first and second hook and fastening means include first fastening strips bonded to said cord protectors and second fastening strips bonded to said correspond cords, said first and second fastening strips securely engaging one another to retain said cord protectors upon and covering said portions of said corresponding cords.

3. In a crane lattice section according to claim 1, wherein each of said cord protectors comprises a high impact plastic casing bonded to a resilient elastomeric material, said plastic casing and elastomeric material wrapping at least partially around a corresponding cord.

4. In a crane lattice section according to claim 1, the improvement further comprising clamps which detachably affix said cord protectors to corresponding cords.

5. In a crane lattice section according to claim 1, wherein said first and second hook and fastening means include disengagable hook and loop fastening material bonded to cord protectors and said corresponding cords to detachably affix said cord protectors to corresponding cords.

6. In a crane lattice section according to claim 1, wherein said cord protectors comprise a uniform elastic material extending between adjacent cords and wrapped at least partially around said adjacent cords.

7. In a crane lattice section according to claim 1, wherein said cord protectors comprise a continuous cord protector which wraps substantially around at least two cords and extends continuously therebetween.

* * * * *